United States Patent [19]

Hirata et al.

[11] Patent Number: 4,905,841

[45] Date of Patent: Mar. 6, 1990

[54] MONEY RECEIVING AND DISBURSING MACHINE

[75] Inventors: Akira Hirata, Kawagoe; Eiichi Yoshikawa, Hasuda, both of Japan

[73] Assignee: Laurel Bank Machines Co., Ltd., Tokyo, Japan

[21] Appl. No.: 223,810

[22] Filed: Jul. 25, 1988

[30] Foreign Application Priority Data

Jul. 29, 1987 [JP] Japan ..... 62-189525

[51] Int. Cl.[4] ..... B07C 5/34

[52] U.S. Cl. ..... 209/534; 209/551; 235/379; 902/11; 902/12

[58] Field of Search ..... 209/534, 551; 194/206; 235/379; 902/11, 12

[56] References Cited

U.S. PATENT DOCUMENTS

| | | | |
|---|---|---|---|
| 4,465,193 | 8/1984 | Kokubo et al. | 209/534 |
| 4,510,380 | 4/1985 | Uchida et al. | 194/206 |
| 4,549,661 | 10/1985 | Morishita et al. | 209/534 |
| 4,726,474 | 2/1988 | Arikawa et al. | 209/534 |
| 4,744,468 | 5/1988 | Goi et al. | 209/534 |
| 4,828,243 | 5/1989 | Ebihara | 209/534 X |
| 4,840,368 | 6/1989 | Uehara | 209/534 X |

FOREIGN PATENT DOCUMENTS

| | | |
|---|---|---|
| 0024704 | 3/1981 | European Pat. Off. . |
| 0109743 | 5/1984 | European Pat. Off. . |
| 60-100283 | 6/1985 | Japan . |
| 2105507 | 3/1983 | United Kingdom . |
| 2122006 | 1/1984 | United Kingdom . |
| 2123592 | 2/1984 | United Kingdom . |
| 2135495 | 8/1984 | United Kingdom . |
| 2199175 | 6/1988 | United Kingdom . |

*Primary Examiner*—Margaret A. Focarino
*Assistant Examiner*—Edward M. Wacyra
*Attorney, Agent, or Firm*—Fleit, Jacobson, Cohn, Price, Holman & Stern

[57] ABSTRACT

A money receiving and disbursing machine being adapted to circulate and use only one predetermined denomination of bank notes received in the machine for disbursing. Bank notes received in the machine other than the predetermined denomination of bank notes are introduced in the received money storage section for storing. In the money receiving process, bank notes are introduced into the machine through the transaction window device. The bank notes are introduced and stored in the circulating money storage section or the received money storage section in accordance with the denominations thereof through the discriminating route and distributing route. In money disbursing process, bank notes are picked out of the circulating money storage section or disbursing money storage section in accordance with a monetary amount of a disbursement order and introduced into the temporary hold section through the money disbursing route and the common route. The bank notes are disbursed through the transaction window device. An abnormal condition occurs in the disbursing bank notes during the money disbursing process, bank note judged as an abnormal condition is introduced and stored in the reject box section through the common route section and the reject route section.

10 Claims, 18 Drawing Sheets

MONEY RECEIVING AND DISBURSING MACHINE

CROSS-REFERENCE TO RELATED APPLICATION

This application is related to co-pending U.S. patent application Ser. No. 113,237 filed 1987 which is assigned to the same assignee as the present application.

BACKGROUND OF THE INVENTION

1. Field of the invention

The present invention relates to a money receiving and disbursing machine for receiving and disbursing bank notes, more specifically to so called a money circulation type machine in which a predetermined denomination of bank note received in the machine is adapted to be used as a money to be disbursed.

2. Description of the Prior Art

Conventionally, there has been known a money circulation type money receiving and disbursing machine in which moneys received in the machine are used as moneys for disbursing.

Japanese Patent Public Disclosure No. 60-100283, laid open to the public on June 4, 1985, discloses a circulation type machine. According to the disclosure, in money receiving operation, moneys received in the machine are discriminated to be introduced into a temporary storage box through a money receiving route thereafter to be picked from the storage box one by one to be sorted and stored in respective money boxes by denomination thereof, such as a ten thousand yen bill box, five thousand yen bill box, and one thousand yen bill box. In disbursing operation, the moneys are picked out of the money boxes one by one in accordance with a customer's request and introduced into a bank note outlet for being disbursed through a disbursing route.

It should however be noted that the above money receiving and disbursing machine is disadvantageous in that the respective money boxes, the money disbursing route, the storage box, and mechanisms for taking the moneys out of the boxes should be arranged not to interfere with one another to make the structure of the machine complicated. As a result, the machine is tend to be bulky. In addition, the above machine has a problem in noise during operation.

Moreover, the machine disclosed in the Japanese Public Disclosure is disadvantageous in that when a specific denomination of bank notes in one of the money boxes are disbursed out, the denomination of bank notes are necessary to be supplied to the one of the money boxes for maintaining a proper money disbursing operation with regard to the respective money boxes by denomination. This makes the management of the money disbursing operation complicated.

According to the conventional machine, when a trouble occurs during a disbursing operation, a bank note in the disbursing route is transferred to the money receiving route. However, when the money receiving route is under an operation for bank notes received in the machine, the bank note in the disbursing route cannot be introduced into the money receiving route from the disbursing route. Therefore, the money disbursing process cannot be initiated until the money receiving process is finished.

SUMMARY OF THE INVENTION

It is therefore object of the present invention to solve the above problems to provide a compact money receiving and disbursing machine.

It is another object of the present invention to provide a money receiving and disbursing machine in which only one denomination of bank note is circulated in the machine for disbursing to reduce a machine noise during money receiving and disbursing process as well as the size of the machine.

It is further object of the present invention to provide a money receiving and disbursing machine which can facilitate a management of the bank notes therein.

It is still further object of the invention to provide a money receiving and disbursing machine in which a money disbursing operation can be carried out even when a money receiving process is under operation.

According to the present invention, the above and other features of the invention can be accomplished by a money receiving and disbursing machine comprising transaction window means opened to outside of the machine, discriminating route means for discriminating a bank note introduced in the machine, a circulating money storage section provided under the discriminating route means and at a central portion of the machine for storing a predetermined denomination of bank notes which are adapted to be circulated and used for disbursing, received money storage means juxtaposed with and in front of the circulating money storage section for storing bank notes other than said predetermined denomination of the bank notes, distributing route means for connecting said discriminating route means with said circulating money storage section and said received money storage means, common route means for selectively connecting one of said distributing route means with said discriminating route means, temporary hold means for temporarily holding bank notes received in the machine until a money discrimination process is completed and returning the bank notes held in the holding means to the transaction window means, disbursing money storage means provided under the circulating money storage section and the received money storage means with an inclined attitude for storing bank notes other than predetermined denomination of the bank notes, money disbursing route means connected with the circulating money storage section and the disbursing money storage means through disbursing mechanism which picks out bank notes stored in the circulating money storage section and the disbursing money storage means one by one, the money disbursing route means being adapted to be connected with the common route means, detecting means provided between the money disbursing route means and the common route means for detecting an abnormal condition in the bank notes being transferred for disbursement, reject fork means provided downstream of the detecting means for introducing the bank notes in abnormal condition to reject route means, and reject box means for receiving the bank notes in the abnormal condition through the reject route means.

The detecting means may be provided on the money disbursing route means.

The money receiving and disbursing machine may further comprise a distribution and conveyance section provided downstream of the detecting means for selectively connecting the money disbursing route means with the common route means or the distributing route means, a switching fork means provided on the distribution and conveyance section for switching the connection of the distribution and conveyance section between the common route means and the distributing route means, and control section for controlling the switching fork means and the reject fork means to thereby introduce the bank note in the abnormal condition selectively to the reject route means or the distributing route means.

According to the present invention, only one predetermined denomination of bank notes received in the machine are circulated for disbursing. Bank notes received in the machine other than the predetermined denomination of bank notes are introduced in the received money storage means for storing. For disbursement, bank notes other than the predetermined denomination cf bank notes are taken out of the disbursing money storage means. In the money receiving process, bank notes are introduced into the money receiving and disbursing machine through the transaction window means. The bank notes are stored temporarily in the temporary hold means through the discriminating route means and common route means. When all the bank notes introduced into the machine are discriminated, the bank notes are returned from the temporary hold means to the transaction window means. Thereafter, the bank notes are introduced and stored in the circulating money storage means or the received money storage means in accordance with the denominations thereof through the discriminating route means and disbursing route means.

In money disbursing process, bank notes are taken out of the circulating money storage section or disbursing money storage means in accordance with a monetary amount of a disbursement order and introduced into the temporary hold means through the money disbursing route means and the common route means. Thereafter the bank notes are disbursed through the transaction window means. In the case when an abnormal condition occurs in the disbursing bank notes during the money disbursing process, bank note judged as an abnormal condition is introduced and stored in the reject box means through the common route means and the reject route means.

The above and other objects of the present invention will be apparent from the following descriptions of preferred embodiment taking reference to the accompanying drawings.

DESCRIPTION OF PREFERRED EMBODIMENTS

This embodiment explained taking reference with FIGS. 1 through 12 relates to a money receiving and disbursing machine according to the present invention wherein only ten thousand yen bill is adapted to be circulated in the machine to be disbursed.

Figure 1:
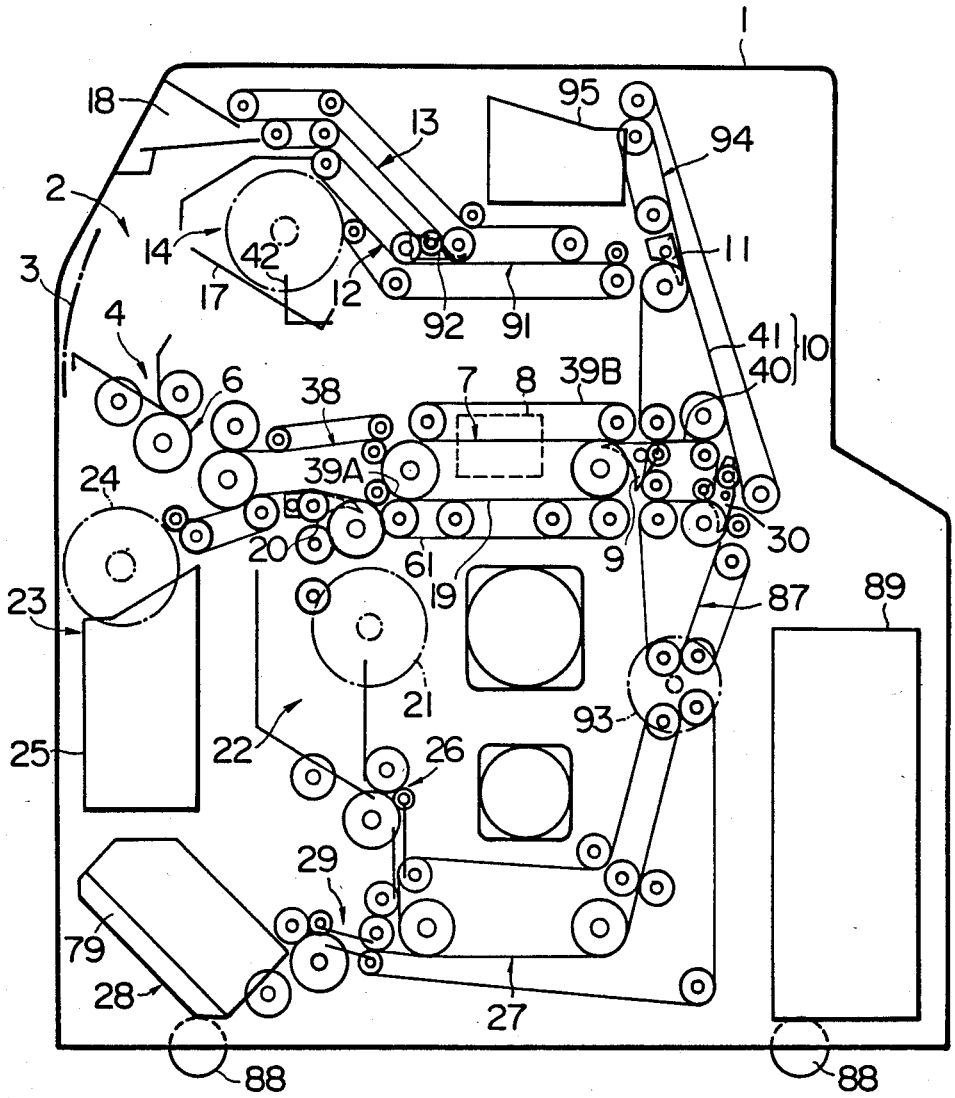
FIG. 1 is a schematic view of a money receiving and disbursing machine in accordance with the present invention.
Figure 2:
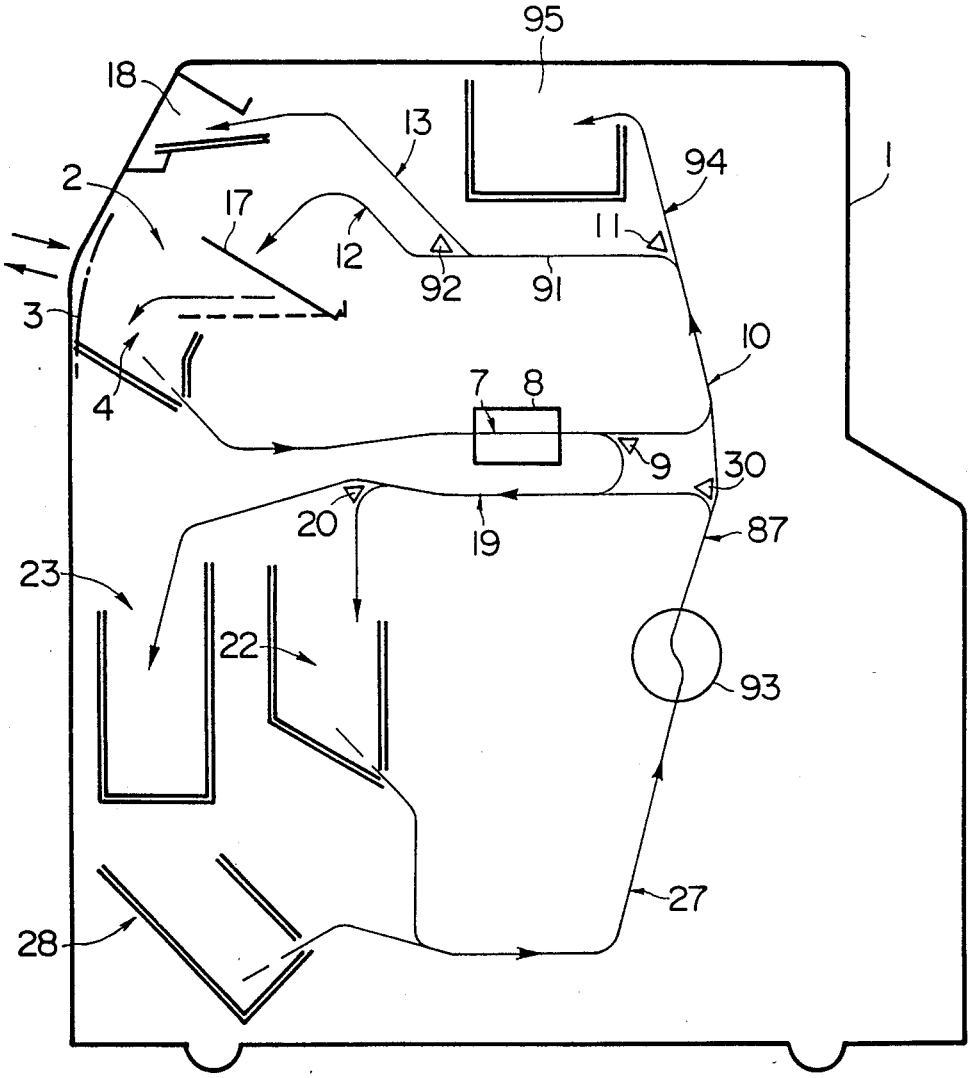
FIG. 2 is a schematic view showing money conveying routes in the machine of FIG. 1.

There is shown a schematic view of the machine 1 in FIG. 1 and FIG. 2. The machine 1 is provided with a transaction window device 2 having a shutter 3 for opening and closing a money receiving and disbursing window 4 clearly shown in FIG. 3. The transaction window device 2 is provided with a base plate 4*a* tilted downwardly from the shutter 3, a vertical plate 4*b* with the base plate 4*a* and the vertical plate 4*b* forming the money receiving and disbursing window 4. The vertical plate 4*b* is adapted to true up the edges of the bank notes on the base plate 4*a*. There is formed an opening 4*c* between the based plate 4*a* and vertical plate 4*b*.

A retainer 5 is provided over the shutter 3 for retaining bank notes introduced in the machine 1 through the window device 2. In the next position of the device 2, there is provided a pick out mechanism 6 for picking the bank note out one by one to introduce it to a discriminating section 8 through a discriminating route 7. The pick out mechanism 6 comprises a pick out roller 31 for picking up a bank note at the lowermost of the bank notes accumulated on the base plate 4*a* one by one through the opening 4*c*, a feed roller 32 for feeding out a bank note picked up by the pick out roller 31, an assist roller 33 provided against the feed roller 32 for preventing two or more bank notes from being fed out therethrough, and an adjust member 34 pivotally mounted on a pin 34*a* for normally closing the opening 4*c* to true up the edges of the bank notes on the base plate 4*a* and for pivoting around the pin 34*a* to open the opening 4*c* in a picking up operation of the bank note. The assist roller 33 may be of a stationary roller or may be driven in the direction opposite to the direction of the bank note fed out so that the assist roller 33 is brought into a frictional engagement with the surface of the bank note to prevent a bank note overlapped on the lowermost bank note from accompanying.

Figure 3:
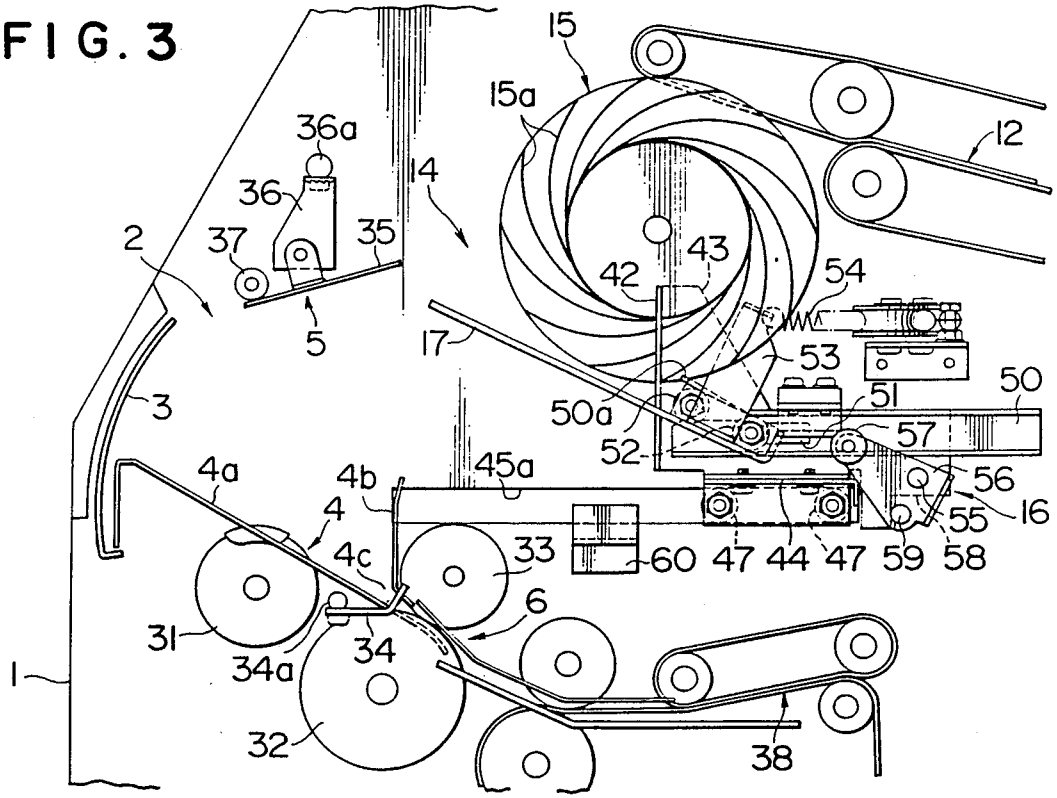
FIG. 3 is a sectional view of a transaction window device and temporary hold device.

The retainer 5 is provided with a retaining plate 35 pivotally mounted on a support member 36 which is mounted on a shaft 36*a* movable in the up and down direction. When the shaft 36*a* is moved downwardly, the retaining plate 35 is engaged with the bank notes on the base plate 4*a* to retain the bank notes between the retaining plate 35 and the base plate 4*a*. The retaining plate 35 is placed over the window 4 when the pick out mechanism 6 is out of operation. In this case, the retaining plate 35 is maintained at an inclined attitude as shown in FIG. 3 so that the plate 35 can be kept away from an operation of a temporary hold device 14 provided in the vicinity cf the retainer mechanism 5 for holding bank note temporarily.

The discriminating route 7 is located rear side or downstream of the pick out mechanism 6 and connected with the mechanism 6 through the introducing section 38 which is constituted by a pair of conveyer belts 39A, 39B. The belts 39A, 39B are adapted to nip the bank note introduced from the pick out mechanism 6 one by one to convey thereacross. During the movement, the bank note is discriminated in the discriminating section 8 with regard to the genuineness and the denomination, and counted with regard to the monetary amount as well as the number of the bank notes passing therethrough.

Downstream of the discriminating section 8, a first fork 9 is located for leading the bank note discriminated in the section 8 to a common route 10 which is extending upwardly from a downstream end portion of the discriminating route 7. A second fork 11 is provided downstream but upward of the common route 10 for transferring the bank note from the common route 10 to a horizontal conveying section 91 which is provided at an upward of the discriminating route 7 and extends substantially horizontally in parallel with the discriminating route 7.

The common route 10 comprises an introducing section 40 horizontally extending from the discriminating route 7 and a conveyer section 41 for conveying the bank note upwardly from the introducing section 40. The horizontal conveying section 91 is located downstream and upward of the conveyer section 41 through the second fork 11. The horizontal conveying section 91 is adapted to communicate selectively with an accumulating route 12 and a receiving money reject route 13 by means of a third fork 92. The accumulating route 12 and the reject route 13 are located in an overlapped relationship with each other in the up and down direction. The temporary hold device 14 is connected to the accumulating rout 12 at the downstream side thereof. The temporary hold device 14 can be communicated with common route 10 through the accumulating route 12 and the horizontal conveying section 91. A reject window 18 opened toward a front side of the machine 1 is connected with the reject route 13.

The temporary hold device 14 is located upward and rearward of the transaction window device 2. The hold device 14 comprises accumulating wheel 15 formed with a plurality of peripheral vanes 15*a* for holding the bank note fed from the accumulating route 12 therebetween one by one as the wheel 15 rotates and a accumulating and conveying mechanism 16 for receiving the bank notes from the wheel 15, accumulating the bank notes and conveying the bank notes horizontally to introduce them downwardly into the window 4.

The accumulating and conveying mechanism 16 is provided with a scraping member 42 located close to the wheel 15 for scraping off the bank note held between the vanes 15*a* and a accumulating board 17 for receiving the bank notes from the wheel 15 to accumulate thereon. The scraping member 42 and the board 17 can be moved in the horizontal direction. For this purpose, the scraping member 42 is formed with side plate portions 43 at the opposite ends. A horizontal plate 44 is provided for supporting the lower portion of the side plate portions 43. The plate 44 extends across a pair of horizontal shafts 46 respectively disposed in a pair of elongated holes 45*a* of a support frame 45. The plate 44 is movably placed on the horizontal shafts 46 by means, of rollers 4. A drive mechanism 48 connected to a reversible drive motor (not shown) though a drive belt 49 is fixed to the plate 44 so that the plate 44 together with the scraping member 42 and accumulating board 17 can be moved along the shafts 46.

Figure 4:
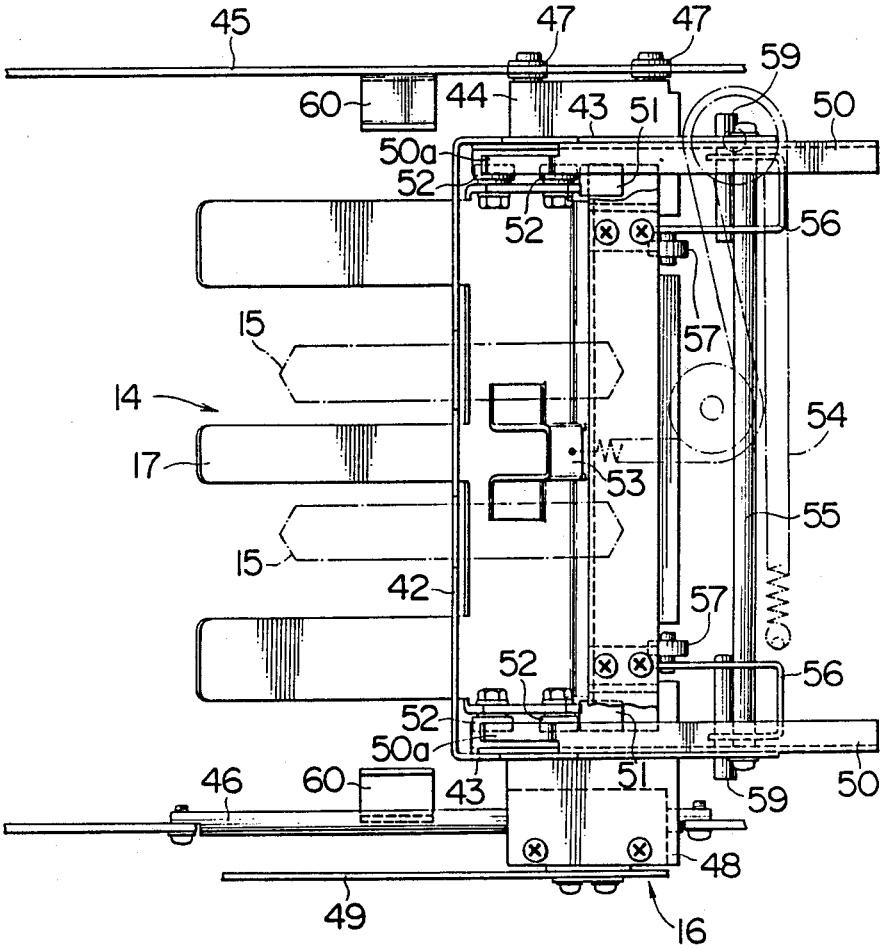
FIG. 4 is a plan view of the temporary hold device.

On the plate 44, a pair of horizontal slide rails 50 of channel like configurations in section are parallel and integrally mounted in parallel with each other. The recess sides thereof face to each other. Each of the rails 50 is formed with a slant portion 50*a*. A pair of stoppers 51 mounted on the machine 1 are disposed insides of the respective rails 50 and projected along the rails 50. As shown in FIG. 4, the accumulating board 17 has split ends which can pass through cut out portions (not shown) formed on the scraping member 42. Guide rollers 52 are disposed in the vicinity of a base portion of the accumulating board 17 so as to contact with the slide rails 50. The base portion of the board 17 is integrally connected with a bracket 53 which is pulled by a spring 54 fixed to the machine 1 so that the guide rollers 52 are brought into contact with the slant portion 50*a* of the slide rails 50 and stoppers 51 to hold the accumulating and conveying mechanism 16 at a tilted state in the forward and upward direction. A pair of push members 56 vertically swingably supported by a support shaft 55 are engaged with the respective side plate portions 43. Each cf the push member 56 is provided with a push roller 57 which is projected toward and retracted from the slide rails 50 as the swingable movement of the push member 56 and an engaging rod 59 which is brought into engagement with a cut out portion 58 formed on the side plate portion 43. The push member is urged by a spring (not shown) in the clockwise direction in FIG. 3 so that the engaging rod 59 is engaged with the cut out portion 58 in a condition as shown in FIG. 3. In this position, the push rollers 57 are projected upwardly between the slide rails 50 at the rearward of the stoppers 51. When the engaging rods 59 are engaged with the cut out portions 58 of the side plate portions 43, a pair of engaging members 60 upwardly projected is located spaced from the engaging rod 59 in the horizontal direction. When the push members 56 are moved horizontally together with the scraping member 42 in the left direction in FIG. 3, the engaging members 60 are brought into contact with the engaging rods 59 to swing the push members 56 in the counterclockwise direction to thereby retract the push rollers 57 from the position where the push rollers 57 is projected upwardly between the pair of slide rails 50.

As shown in FIG. 1, there is provided a distributing route 19 under the discriminating section 8. The distributing route 19 receives bank notes judged as the ten thousand yen bill by means of the first fork 9. A accumulating wheel 21 for circulating bank notes is provided downward of the distributing route 19 for receiving the bank notes from the distributing route 19 through a fourth fork 20. The bank notes judged as the ten thousand yen bill are introduced from the wheel 21 to a circulating money storage section 22 which is located downward of the wheel 21. A receiving money storage device 23 is located forwardly juxtaposed with the circulating money storage section 22. The receiving money storage device 23 comprises an accumulating wheel 24 and a received money box 25. The receiving money storage device 23 is adapted to receive bank notes other than the ten thousand yen bill by means of the fourth fork 20 through the wheel 24 and to store the bank notes in the money box 25.

The distributing route 19 is constituted by utilizing the lower conveyer belt 39A of the belt 39A, 39B which constitute the discriminating route 7. Another conveyer belt 61 is positioned facing to the belt 39A so that the belts 61 and 39A hold a bank note therebetween to convey it in the direction opposite to the conveying direction of the discriminating route 7.

Figure 6:
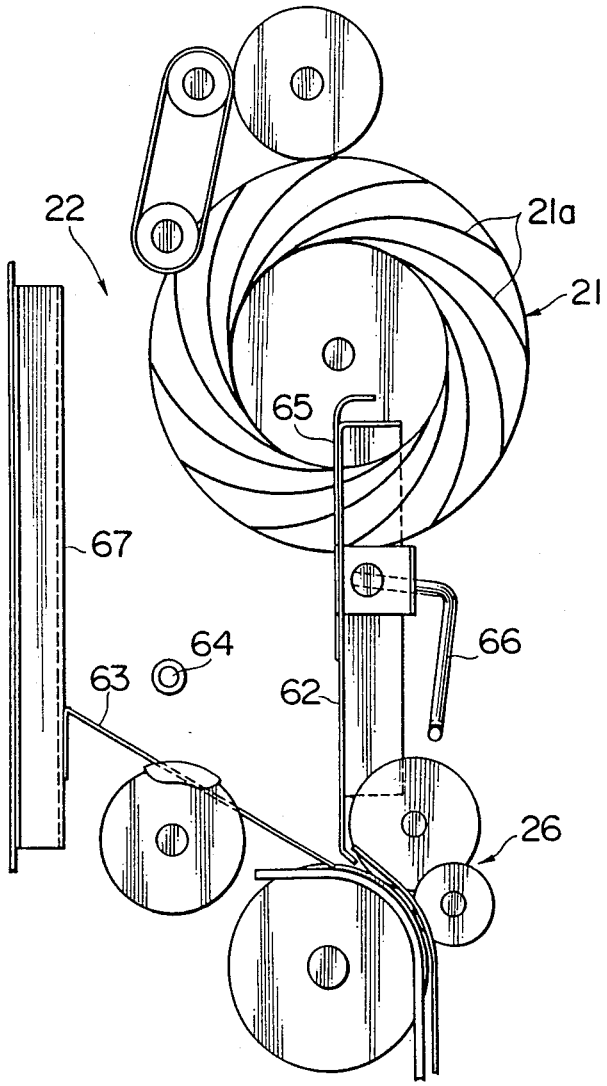
FIG. 6 is a sectional view of a circulating money storage device.

The circulating money storage section 22, as shown in FIG. 6 comprises the wheel 21 having a plurality of vanes 21*a* at the peripheral portion, a scraping member 62 disposed opposite sides of the wheel 21, a accumulating board 63 on which bank notes are accumulated in an overlapped relationship with one another, a sensor 64 for detecting the amount of the bank note accumulated on the accumulating board 63 and a retaining plate 65 for retaining the top of the bank notes accumulated on the board 63 when the number of the bank notes on the board 63 reaches a predetermined value. The retaining plate 65 is swung by a driving mechanism (not shown ) so that the retaining board 65 is kept at a retracted position spaced upwardly from the board 63 as shown in FIG. 6.

On a vertical front plate 67, an opening having a door (not shown) is provided for introducing bank notes therethrough.

Figure 7:
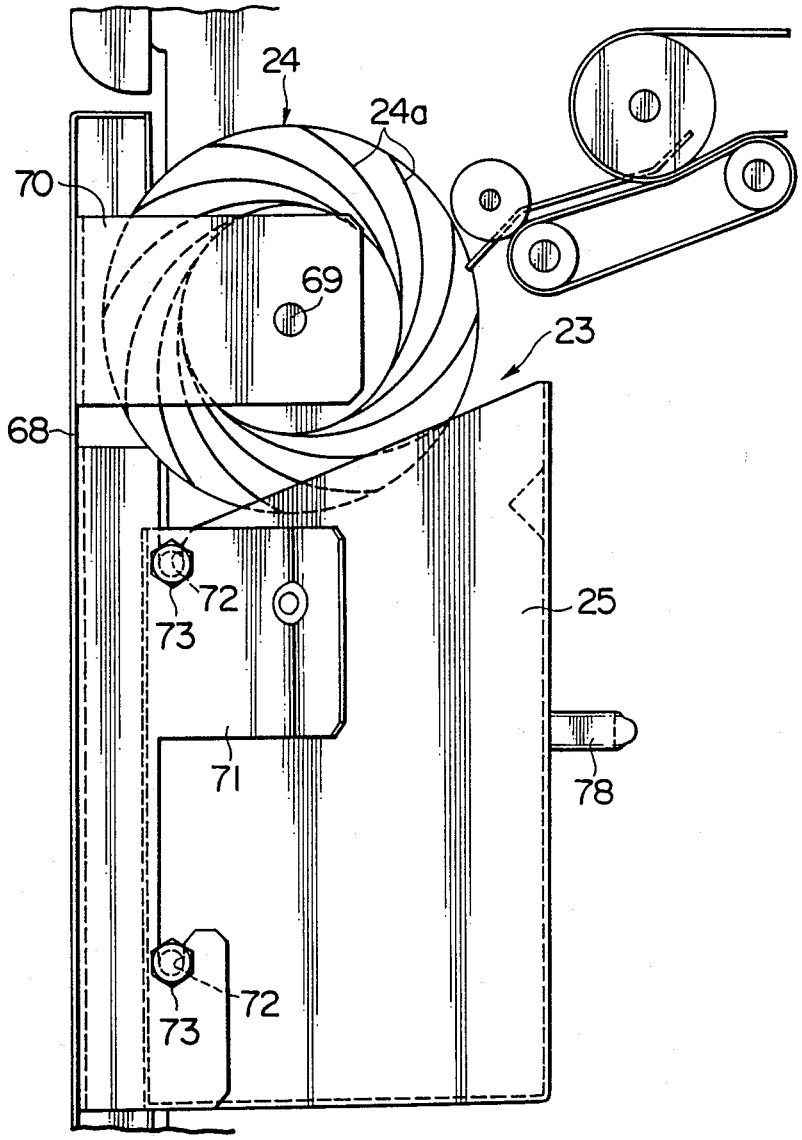
FIG. 7 is an end view of a received money storage device.

The receiving money storage device 23 juxtaposed with the circulating money storage section 22, as shown in FIG. 7 is provided with the accumulating wheel 24 having a plurality of vanes 24*a* for holding a bank note therebetween one by one and the received money box 25 as aforementioned.

A door 68 is mounted on a front side of the machine 1 so as to be opened forwardly. The accumulating wheel 24 is rotatably mounted on a rotation shaft 69 which is supported by a bracket 70 fixed to the door 68 so that the wheel 24 can be drawn out forwardly when the door 68 is opened.

There are provided downward of the bracket 70 a bracket 71 having a pair of cut out portions 72 engaged with pins 73 projected from the opposite sides of the received money box 25 so that the box 25 can move together with the door 68.

Figure 8:
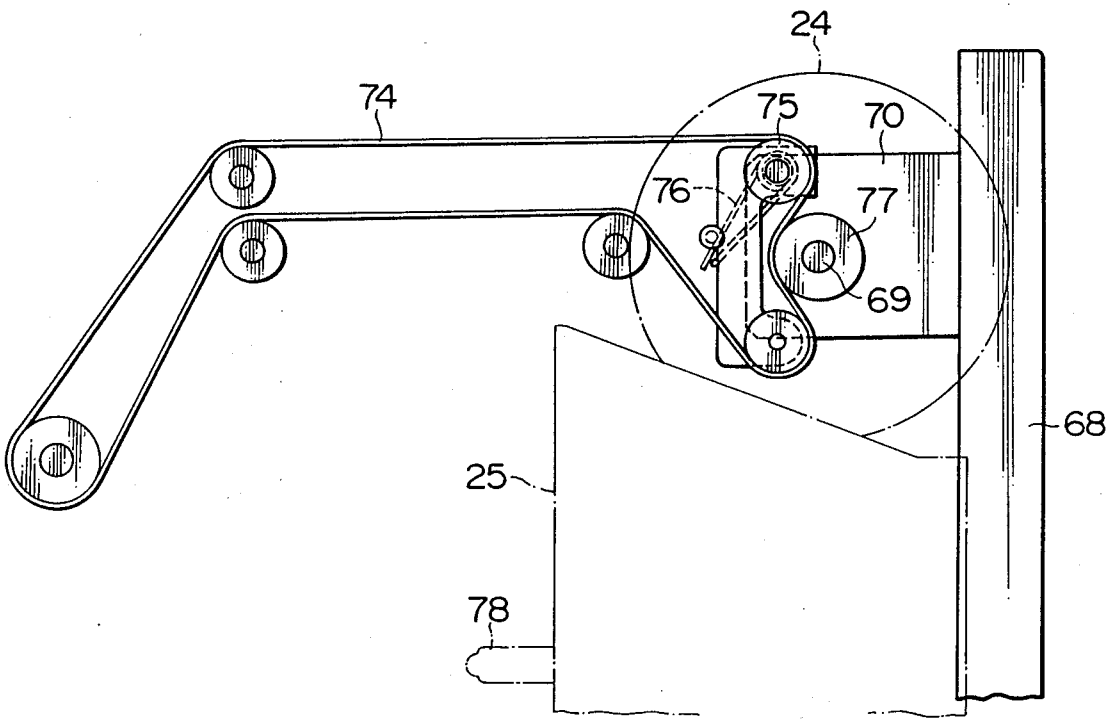
FIG. 8 is a side view showing a connection of an accumulating wheel of the received money storage device and a driving section therefor.

As shown in FIG. 8, a driving section for driving the accumulating wheel 24 is mounted on the machine 1 to drive a timing belt 74. An assist pulley 75 engaged with the timing belt 74 is movably and resiliently supported by a spring to provide the timing belt 74 with a proper tensional force. When the accumulating wheel 24 is mounted on the machine 1, a drive roller 77 fixed to the shaft 69 is brought into contact with the timing belt 74 so that a driving force is transmitted through the drive roller 77 from the timing belt 74 to the wheel 24. The received money box 25 is removably mounted on the door 68 and provided with a handle 78 so that the box 25 can be carried by using the handle 78.

As shown in FIG. 1, the machine 1 is provided a money disbursing mechanism having a money disbursing route 27 to which bank notes of the ten thousand yen bill is introduced downwardly from the circulating money storage section 22 through a pick out device 26. Forward of the money disbursing route 27, there is disposed a disbursing money storage device 28 for supplying bank notes other than the ten thousand yen bill, and a pick out mechanism 29 for disbursing moneys connected to the disbursing route 27.

The disbursing route 27 is extended horizontally rearward of the machine and thereafter extended upwardly at the rear end portion to be connected with a disbursing money detecting section 93. The detecting section 93 is adapted to detect an abnormal transportation of the bank notes in a manner of checking whether or not two or more the disbursing bank notes are transported in an overlapped relationship on the disbursing route 27. The money disbursing mechanism is provided with a disbursing money reject route 94 at the upper portion of the machine 1. The reject route 94 is adapted to associate with the second fork 11 to receive disbursing bank notes rejected in the detecting section 93 and introduce them to a reject box 95 located at an upper portion of the machine 1 when a money disbursing process is under operation. There is provided a fifth fork 30 for switching a money conveying route between the common route 10 and the distributing route 19.

Figure 9:
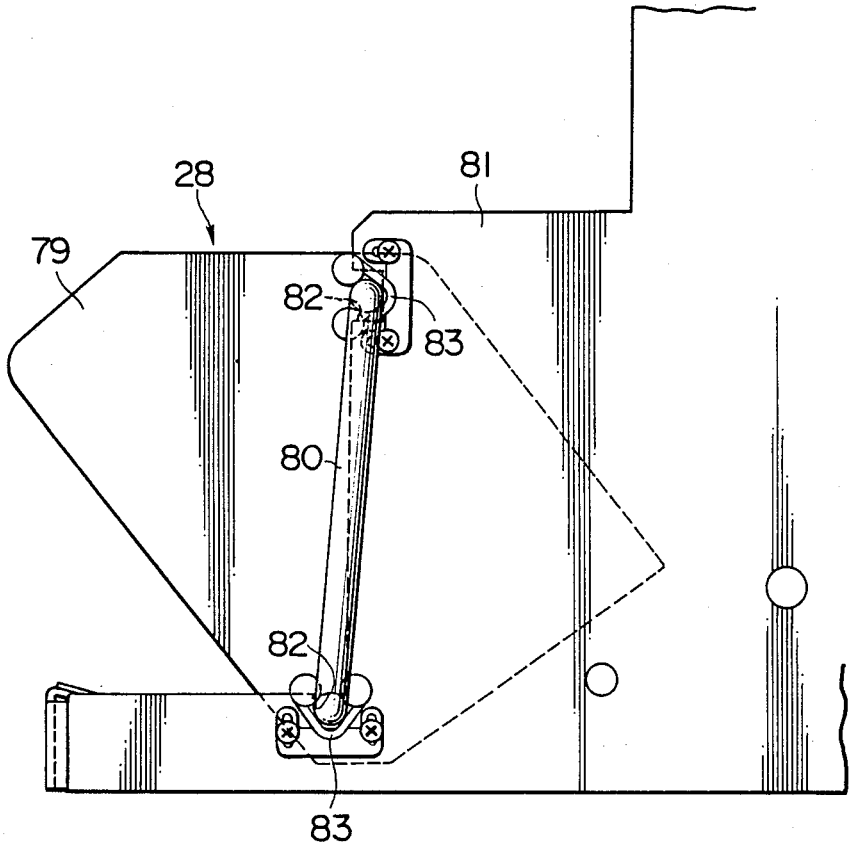
FIG. 9 is side view showing a money disbursing device of which a money disbursing box is mounted on the machine.
Figure 10:
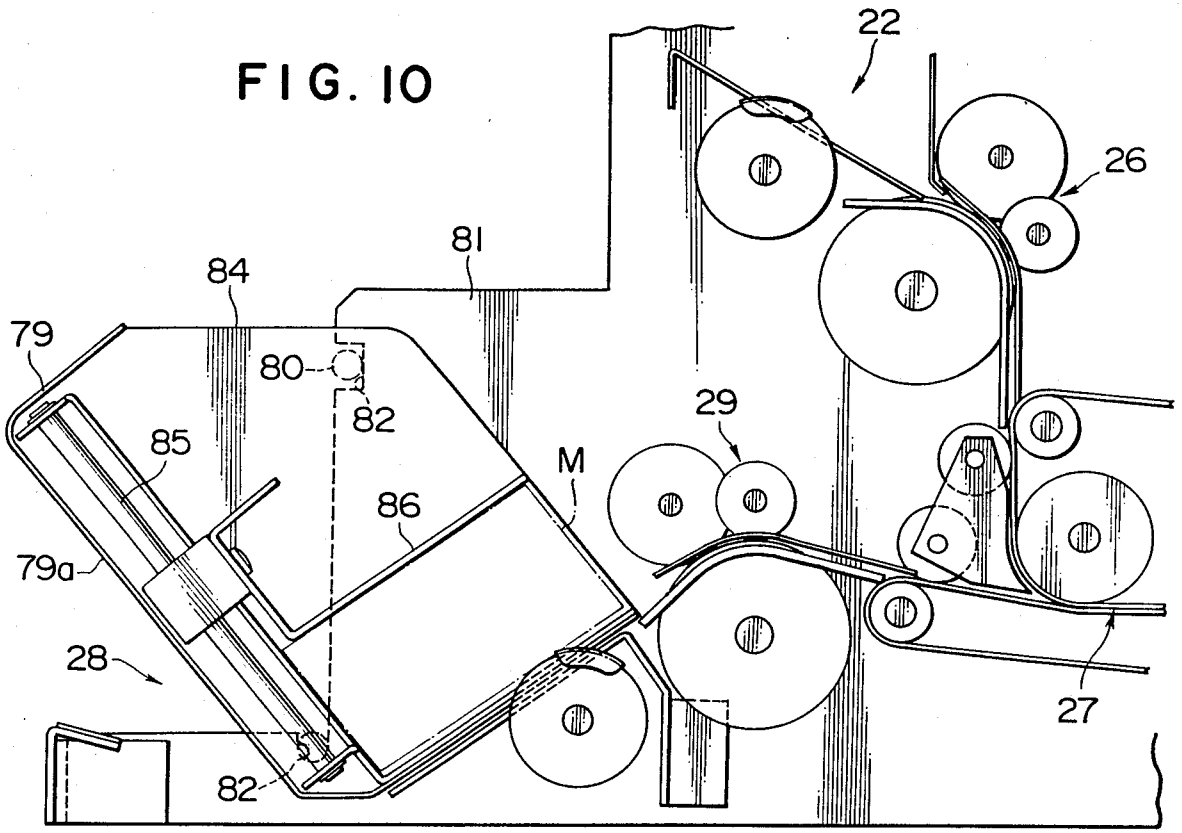
FIG. 10 is a sectional view showing the money disbursing device.

The disbursing money storage device 28 is located downward of the received money box 25 with the disbursing box 79 being inclined downwardly rearwardly with regard to the machine 1. As shown in FIG. 9, The disbursing money box 79 is provided with U-shaped engaging levers 80 at the opposite side thereof. When the levers 80 is oriented to extend vertically, the disbursing money box 79 is maintained at the inclined attitude as shown in FIG. 1. At the opposite sides of the disbursing box 79, there is disposed a support frame 81 having a pair of cut out portions 82 with which the upper end and lower end of the engaging levers 80 are engaged respectively so that the disbursing money box 79 is mounted on the machine 1 with the inclined state. The disbursing money box 79 is formed with an opening 84 at the top end. The disbursing money box 79 is exposed forwardly to the outside of the machine 1. When the box 79 is swung around the lower portion of the levers 80 in the counterclockwise direction in FIG. 10, the opening 84 is opened to outside of the machine 1. In the vicinity of the cut out portions 82, there is disposed a joint member 83 having a spring member with which the levers 80 are removably engaged so that the box is maintained at the inclined attitude.

The box 79 is provided inside thereof with a supporting rod extending along a side plate 79*a* on which a retaining plate 86 is slidably mounted for urging stacked bank note M in the box 79 by gravity thereof.

As shown FIG. 1, At the front end of the disbursing money route 27, there are located the pick out mechanism 26 for the circulating moneys of the circulating money storage section 22, and the pick out mechanism 29 for disbursing money of the disbursing money storage device 23. The disbursing money route 27 is connected with a money distribution and conveyance section 87 at the rear end thereof.

The money distribution and conveyance section 87 is connected with the front end of the upward conveying section 41 of the common route 10 and the front end of the distribution route 19. The fifth fork 30 positioned at the joint portion of the routes 10 and 19 is adapted to distribute the bank notes therethrough to the routes 10 and 19. There is provided the disbursing money detecting section 93 between the disbursing route 27 and the distribution and conveyance section 87. The detecting section 93 detects an abnormal conveyance of the bank note such as an overlapped conveyance in which two or more bank note are conveyed in an overlapped relationship with one another, and a conveyance with an abnormal attitude of the bank note. The detecting section 93 also counts the number of the bank note passing therethrough to check other denomination of the bank note.

The reject route 94 is extended upwardly from the common route 10 so that the reject route 94 can be communicated selectively with the common route 10 and the horizontal conveying section 91 by means of the second fork 11. When the reject route 94 is communicated with the common route 10 by the fork 11, the bank notes are introduced into the reject box 95 located over the horizontal conveying route 91.

In addition, the machine 1 is provided with casters for movably supporting the machine 1 and a control section 89 for controlling the forks and pick out mechanisms and the like.

Hereinafter there is described an operation of the machine 1 taking reference with FIG. 5 (A) through 5(E) and FIG. 11, and FIG. 12(A) through 12 (C). In this embodiment, the ten thousand yen bill and one thousand yen bill are used as disbursing bank notes.

Money receiving and distribution process

Figures 11, 11A:
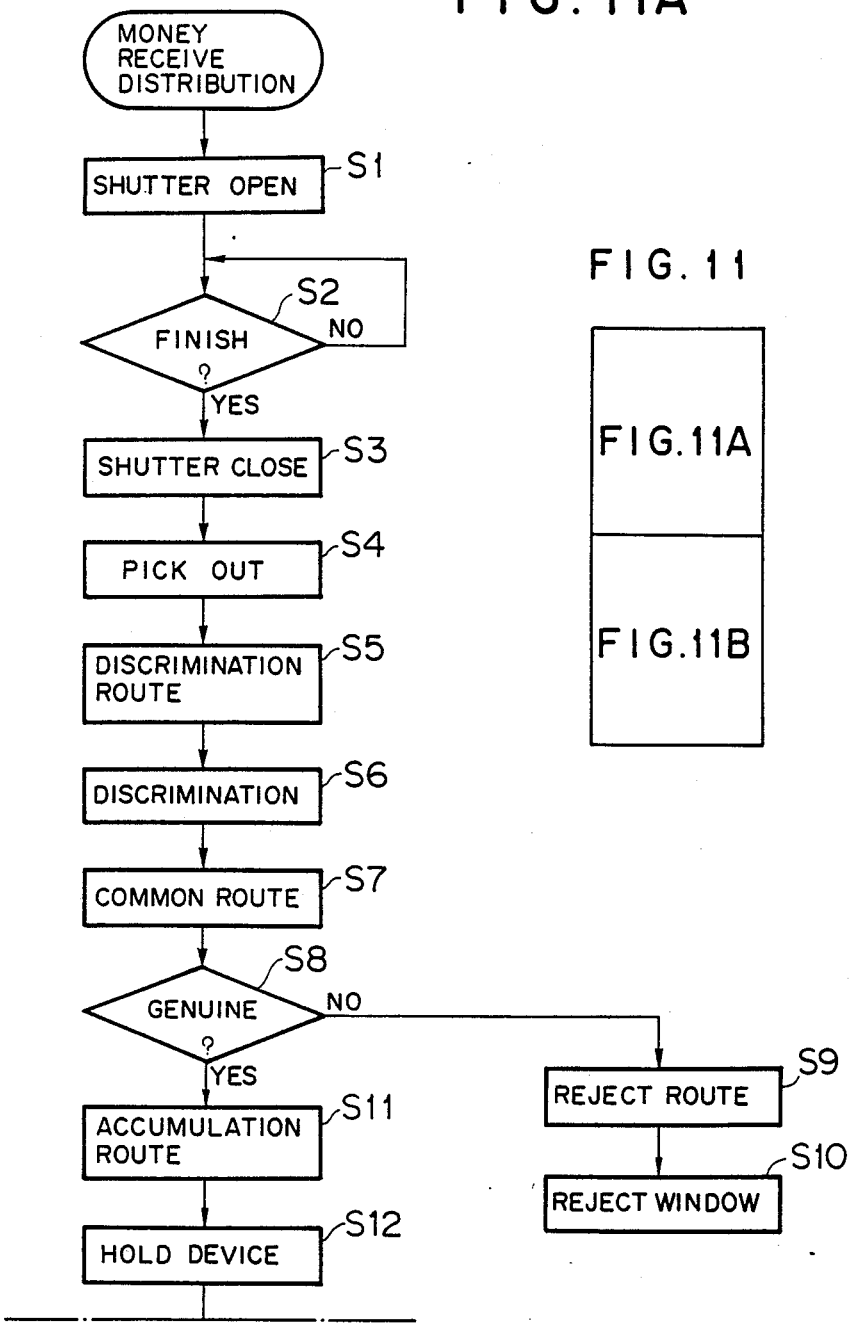
FIG. 11 which includes
FIGS. 11(A) and 11(B) is a flow chart showing a control for money receiving and distributing.
Figure 11B:
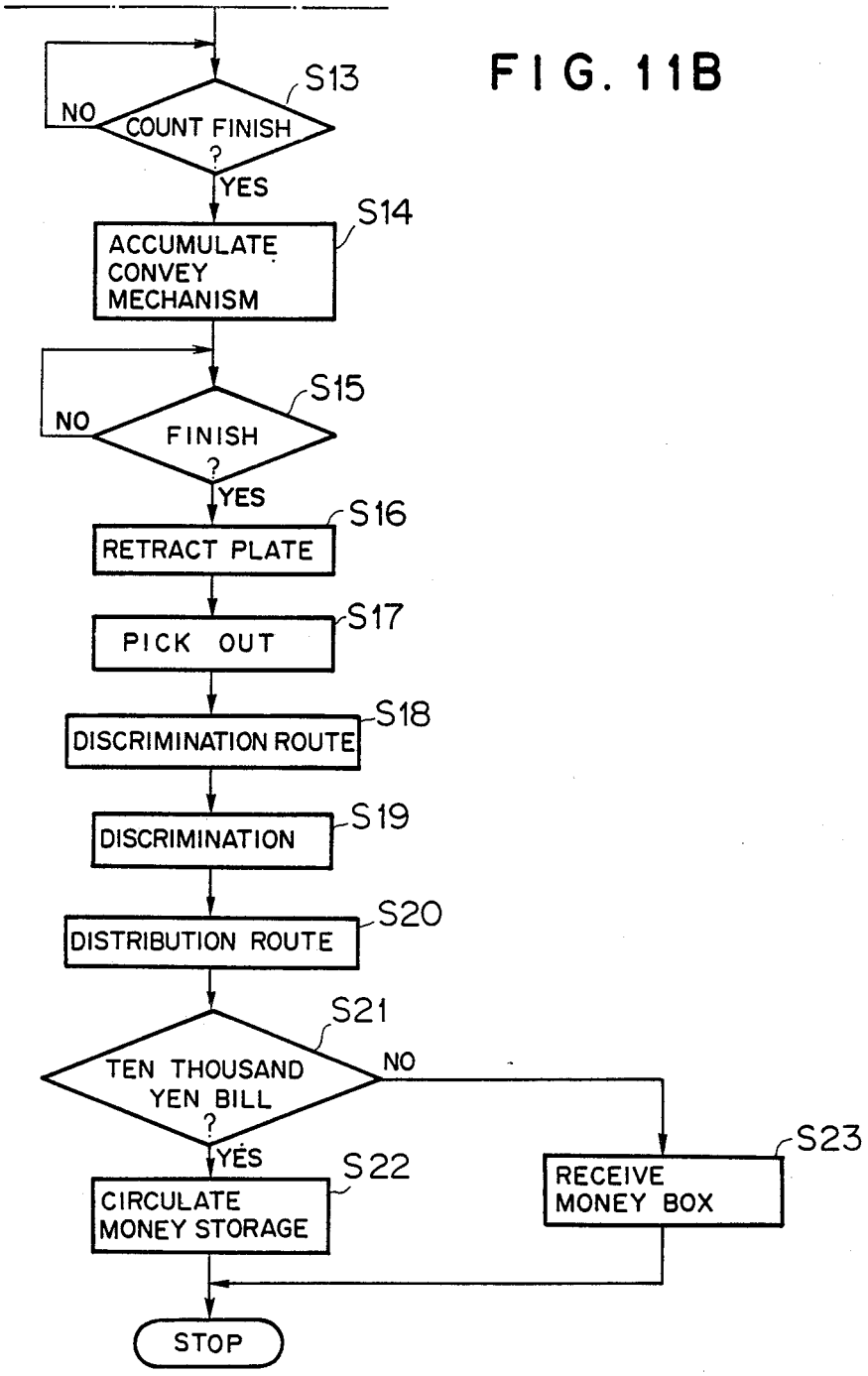
Figure 12A:
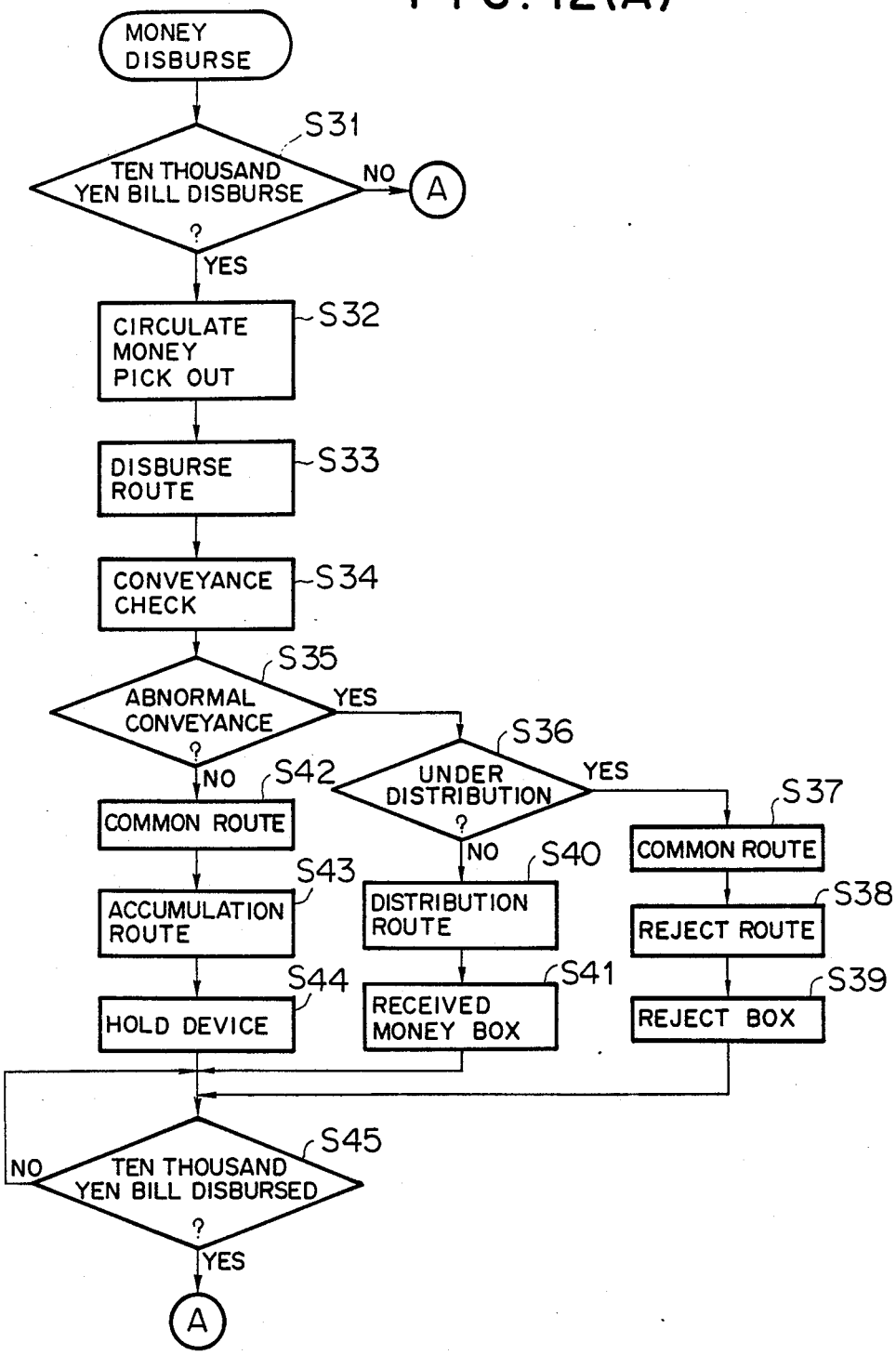
FIG. 12(A) through FIG. 12(C) are flow charts for money disbursing operation.

Now referring to FIG. 11, the shutter 3 of the transaction device 2 is opened in accordance with an indication by a customer of depositing money(S1). When the completion of the money entering is confirmed by the customer's operation, the shutter 3 is closed (S2, S3).

The bank notes introduced into the machine 1 are fed to the introducing section 38 one by one through the pick out mechanism 6 (S4).

The discriminating route 7 conveys the bank notes from the introducing section 38 to the discriminating section 8 (S5). The discriminating section 8 discriminates the bank notes one by one while conveying with regard to the genuineness, denomination and counts the bank notes which are judged as genuine money (S6). In this particular process, the discriminating route 7 is communicated with the common route 10 and the horizontal conveying route 91 by means of the first and second forks 9 and 11 so that the bank notes passed through the discriminating section 8 are introduced into the horizontal conveying route 91 (S7) The bank note which is judged as a counterfeit is introduced into the received money reject route 13 which is now communicated with the horizontal conveying route 91 by means of the third fork 92 (S8, S9). Thereafter, the counterfeit is introduced into the reject window 18 to be returned (S10).

On the other hand, when the bank note is judged as genuine in the discriminating section 8, the third fork 92 is actuated to connect the accumulating route 12 with the horizontal conveying route 91 so that the bank note is introduced into the temporary hold device 14 through the accumulating route 12 (S8, S11, S12). Then machine 1 judges whether or not the received money counting operation is completed with regard to all the money introduced in the machine 1 through the transaction window 2 (S13).

In next step S15 and S16, the bank notes are transferred from the temporary hold device 14 to the money receiving window 4.

Hereinafter, the operation in step S15 and S16 is described taking reference with FIG. 5(A) through 5(E).

Figure 5A:
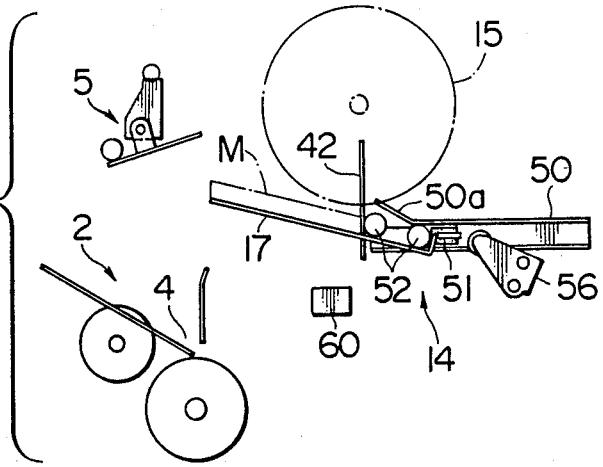
FIG. 5(A) through 5(E) are views showing an operation of the temporary hold device.
Figure 5B:
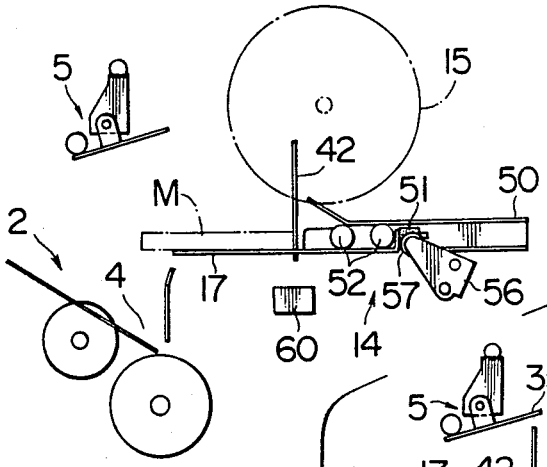

The temporary hold device 14 receives the bank notes through the accumulating wheel 15. The bank notes as shown in FIG. 5(A) by a sign M are accumulated on the accumulating plate 17 sequentially as the wheel 15 rotates. The accumulating plate 17 is swung around the guide roller 52 in accordance with the amount of money accumulation thereon by gravity in the counterclockwise direction in FIG. 5(A). When the accumulating operation of the bank notes M is completed, a drive motor (not shown) is actuated to move the slide rails 50 along the elongated holes 45*a* shown in FIG. 3 and the horizontal shafts 46 shown in FIG. 4. In this movement, the accumulating plate 17 moves relative to the rails 50 because of a resilient force of the spring 54 to be brought into contact with the bush rollers 57 of the bush member 56 so that the accumulating plate is kept at a horizontal angular position as extended along the rails 50 as shown in FIG. 5(B).

Figure 5C:
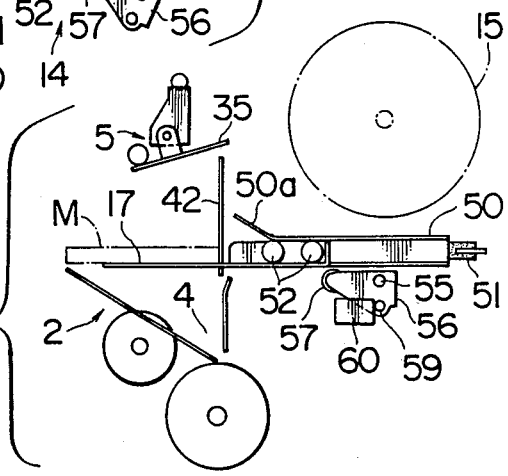
Figure 5D:
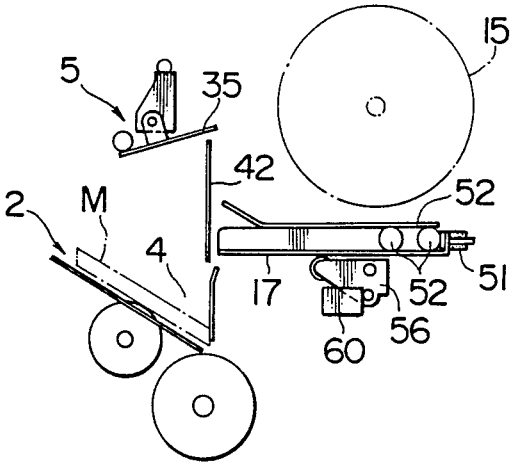
Figure 5E:
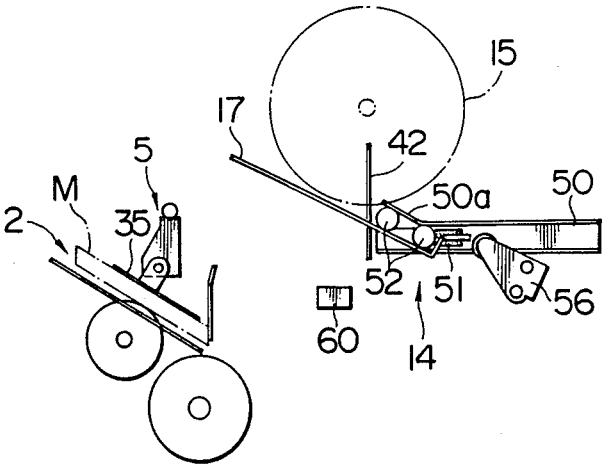

As shown in FIG. 5(C), when the plate 17 is moved along the slide rails 50 to a position over the money transaction window 4 by means of the push rollers 57, the engaging members 60 are brought into contact with the engaging shaft 59 of the push member 56 so that the the push member 56 is swung around the shaft 55 in the counterclockwise direction. As a result, the accumulating plate 17 is disengaged from the push rollers 57 so that the plate 17 is pulled by the spring 54 to move reversely to contact with the stoppers 51 as shown in FIG. 5(D). At this position, the bank notes M on the plate 17 fall into the window 4, namely the bank note received in the machine 1 are introduced again to the money receiving window 4. Thereafter the drive motor is actuated to rotate reversely so that the accumulating plate 17 is returned to the position as shown in FIG. 5(E). FIG. 5(E) shows that the money transaction window device 2 is in the money receiving operation wherein the bank notes M on the base plate 4*a* is pressed by the retaining plate 35 of the retainer device 5.

Then, the bank notes introduced in the window 4 are picked out therefrom by the pick out mechanism 6 one by one (S17) to be introduced into the discriminating section 8 through the discriminating route 7 (S18).

In the discriminating section 8, the denomination of the bank notes is discriminated (S19). After the discrimination, the bank notes of the ten thousand yen bill are introduced into the circulating money storage 22 and stored therein through the distributing route 19 by an assistance of the first fork 9 (S21, S22). The bank notes other than the ten thousand yen bill are introduced and stored in the received money box 25 through the distributing route 19 by an assistance of the fourth fork 20 (S21, S23).

Money disbursing process

Figure 12B:
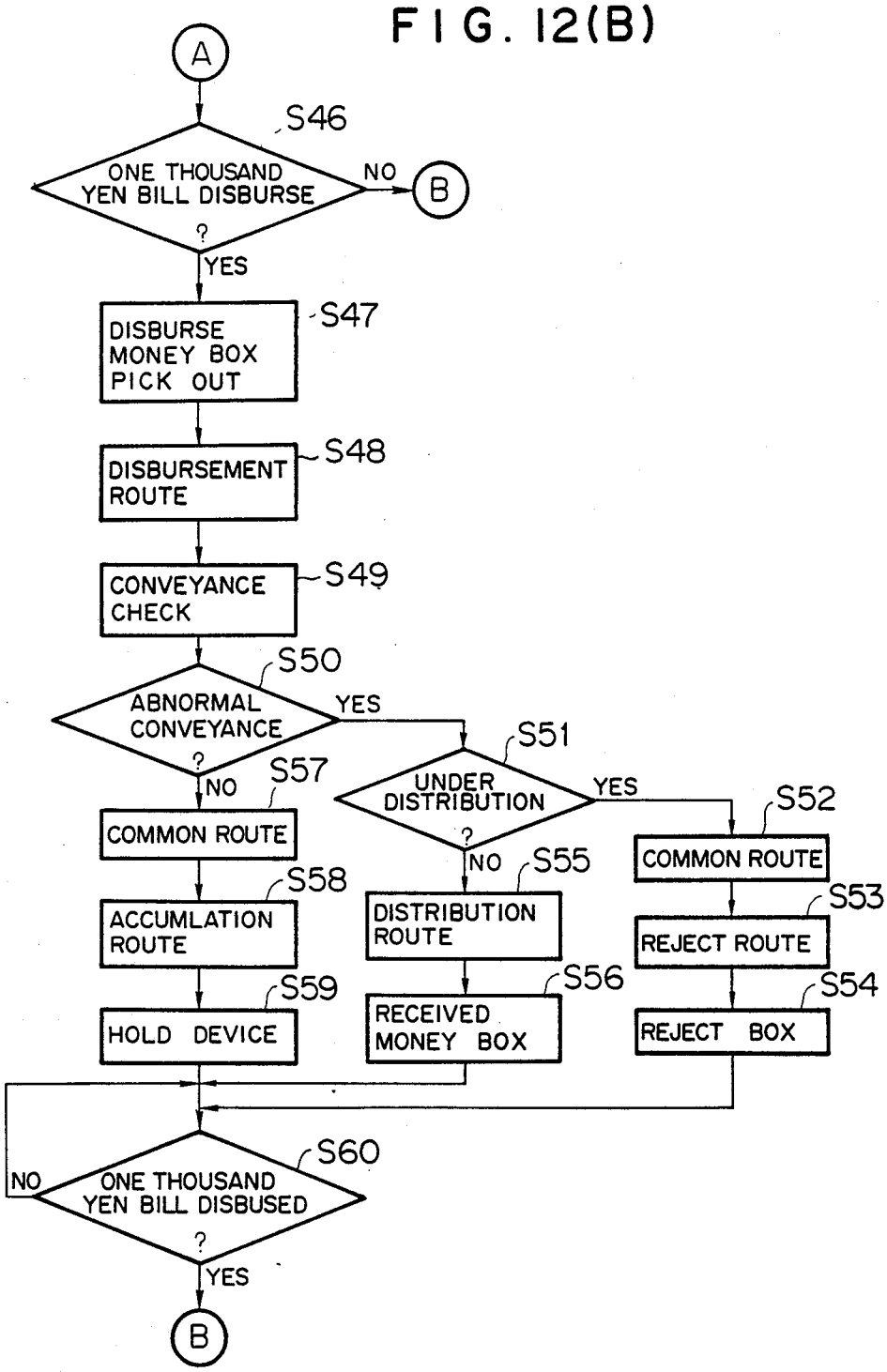
Figure 12C:
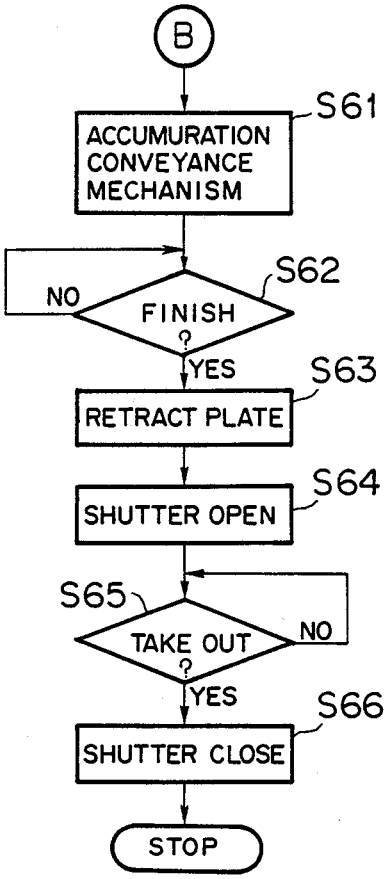

Hereinafter there is described a money disbursing process taking reference with FIG. 12(A) through 12(C).

When there is an order of a money disbursement, the machine 1 judges whether or not the ten thousand yen bill is requested (S31). If the ten thousand yen bill is requested, the pick out mechanism 26 in the circulating money storage 22 is actuated to pick the ten thousand yen bill out of the storage 22 one by one in accordance with the request (S32). The bank notes of the ten thousand yen bill are conveyed to be introduced into the disbursing money detecting section 93 through the money disbursing route 27. At the rear end portion, the detecting section counts the bank note being conveyed and checks an abnormal conveyance such as the overlapped conveyance of the bank note (S34). If an abnormal conveyance is detected, a judgment is made as to whether or not the distributing route 19 is under operation (S35, S36). When the distributing route 19 is under operation, the distribution and conveyance route 87 is connected with the common route 10 through the fifth fork 30 so as to introduce the bank notes to the common route 10 (S35, S37). Then the bank notes are introduced into the disbursing money reject route 94 which is now connected with the common route 10 by means of the second fork 11 (S38). The bank notes thereafter are introduced and stored in the reject box 95 through the reject route 94 (S39).

In the judgment in step S36, if the distributing route 19 is out of operation, the bank notes judged as an abnormal conveyance are introduced into the distributing route 19 which is now connected with the distribution and conveyance route 87 by means of the fifth fork 30 (S40). Thereafter the bank notes are introduced into the received money box 25 of the received money storage device 23 through the distributing route 19 connected with the device 23 by means of the fourth fork 20 (S41).

In the judgment of step S35, when the bank notes are judged as being properly conveyed, the bank note is introduced into the common route 10 which is connected with the distribution and conveyance route 87 by means of the fifth fork 30. Thereafter, the bank notes are introduced into the accumulating route 12 which is connected with the common route 10 by the second fork 11 (S43). The bank notes conveyed by the accumulating route 12 are thereafter introduced into the temporary hold device 14 and accumulated on the accumulating plate 17 (S44).

A judgment is made as to whether or not the disbursement operation for the ten thousand yen bill is completed (S45). If the disbursement is completed for the ten thousand yen bill, in turn a judgment is made as to whether or not there is a request of disbursement for the one thousand yen bill (S46). When the one thousand yen bill is requested, the pick out mechanism 29 for the disbursing money of the disbursing money storage device 28 is actuated to pick the one thousand yen bill one by one out of the disbursing money box 79.

The bank notes from the box 79 are transferred through the disbursing money route 27 (S48).

The bank notes of the one thousand yen bill are conveyed to be introduced into the disbursing money detecting section 93 through the money disbursing route 27. At the rear end portion, the detecting section counts the bank note being conveyed and checks an abnormal conveyance such as the overlapped conveyance of the bank note (S49). If an abnormal conveyance is detected, a judgment is made as to whether or not the distributing route 19 is under operation or occupied by the bank notes received in the machine 1 through the transaction window device 2(S50, S51). When the distributing route 19 is under operation, the distribution and conveyance route 87 is connected with the common route 10 through the fifth fork 30 so as to introduce the bank notes to the common route 10 (S50, S52). Then the bank notes are introduced into the disbursing money reject route 94 which is now connected with the common route 10 by means of the second fork 11 (S53). The bank notes thereafter are introduced and stored in the reject box 95 through the reject route 94 (S54).

In the judgment in step S51, if the distributing route 19 is out of operation or not occupied by the bank notes received in the machine 1 through the transaction window device 2, the bank notes judged as an abnormal conveyance are introduced into the distributing route 19 which is now connected with the distribution and conveyance route 87 by means of the fifth fork 30 (S55). Thereafter the bank notes in the abnormal conveyance are introduced into the received money box 25 of the received money storage device 23 through the distributing route 19 connected with the device 23 by means of the fourth fork 20 (S56).

In the judgment of step S50, when the bank notes are judges as being properly conveyed, the bank note is introduced into the common route 10 which is connected with the distribution and conveyance route 87 by means of the fifth fork 30 (S57). Thereafter, the bank notes are introduced into the accumulating route 12 which is connected with the common route 10 by the second fork 11 (S58). The bank notes conveyed by the accumulating route 12 are thereafter introduced into the temporary hold device 14 and accumulated on the accumulating plate 17 (S59).

The bank notes accumulated on the accumulating plate 17 of the temporary hold device 14 in accordance with the money disbursing request are transferred to the money receiving and disbursing window 4 by the operation as aforementioned in connection with FIG. 5(A) through 5(E) (S60 through S63). Then the shutter 3 is opened for the customer to take out the money disbursed in the transaction window 4 of the transaction device 4 (S64).

After a confirmation as to whether the customer takes out the money disbursed on the window, the shutter 3 is closed (S65, S66).

Money Charging Operation

In charging the ten thousand yen bill, the door 68 carrying the received money storage device 23 is opened to draw out the circulating money storage 22 from the front end of the machine 1 so that the bank notes of the ten thousand yen bill can be loaded on the storage 22. Alternatively the ten thousand yen bill can be charged from the money receiving and disbursing window device 2 in the money receiving process. In this case the amount of the money charged can be counted automatically.

In charging the one thousand yen bill on the machine 1, an upper portion of the engaging lever 80 of the money disbursing box 79 is disengaged from the joint member 83 and from the cut out portion 82 thereafter is swung around the lower end of the engaging lever 80 in the counterclockwise direction in FIG. 8 so that the opening 84 of the box 79 is opened outside of the machine 1 to allow the bank notes to be loaded therein through the opening 84.

Money Collecting Operation

In collecting the ten thousand yen bill from the machine 1, the money disbursing route 27 is connected with the received money storage device 23 through the distribution and conveyance section 87 by controlling the fourth fork 20 and fifth fork 30. The pick out mechanism 26 of the circulating money storage 22 is actuated to pick out the bank note one by one to introduce it to the received money box 25 of the received money storage device 23. Then the door 68 is opened to remove the box 25 so that the bank notes of the ten thousand yen bill stored in the box 25 are collected from the box 25.

The one thousand yen bill are collected from the disbursing box 79 opened outside of the machine 1 in the same way as the money charging operation. Alternatively, the one thousand yen bill can be collected through the same way as the ten thousand yen bill. In this case, the disbursing route 27 is connected with the disbursing money storage device 28 through the distribution and conveyance rout 87 so that the one thousand yen bill is picked out from the disbursing money box 79 by means of the pick out mechanism 29 one by one. Thereafter the bank note is stored in the received money box 25 to be collected in the same way as the ten thousand yen bill.

According to the aforementioned embodiment, only the ten thousand yen bill among the bank notes received in the machine 1 is circulated for disbursement. The common route 10 and the accumulating route 12, the temporary hold device 14 and the transaction window device 2 are commonly used for both the money receiving and distributing process and the money disbursing process.

In this connection, the machine 1 is provided with the circulating money storage section 22, the received money storage device 23, the disbursing money storage device 28 and the reject box 95 as the devices for storing bank notes.

Among this storing devices, the reject box 95 is merely used for storing the bank notes but the bank notes in the box 95 are never taken out thereof.

As a result, the machine 1 is reduced in the number of the money storing devices and money pick out mechanisms. To the contrary the machine 1 is provide many money processing routes and devices in different money processing operations such as money receiving, distributing, disbursing, charging and collecting so that the machine 1 is increased in the commonly used space to accomplish a sophisticated compact structure. In this regard, the disbursing money box 79 is mounted on the machine with an inclined attitude so that the machine 1 can be reduced in size specifically in the up and down direction.

The temporary hold device 14 is adapted to transfer the bank notes accumulated on the accumulating plate 17 to the accumulating plate 4a of the transaction window device 2 in the manner that the bank notes fall on the plate 4a as a wad thereof without using any clamping device.

The circulating money storage on which the bank notes are loaded automatically is positioned at a central portion of the machine 1. On the other hand, the received money storage device 23 which stores the bank notes received in the machine 1 and the disbursing money storage device 28 which stores the bank notes for disbursing are placed in the vicinity of the front end of the machine 1 so as to facilitate to access to the the devices 23 and 28.

Further even when the money disbursing operation is initiated just after a money depositing operation occurs wherein the distributing route 19 is occupied by the bank notes introduced by the depositing operation, the bank notes of an abnormal conveyance during the money disbursing operation can be successfully introduced into the reject box 95 through the reject route 94.

Figure 13:
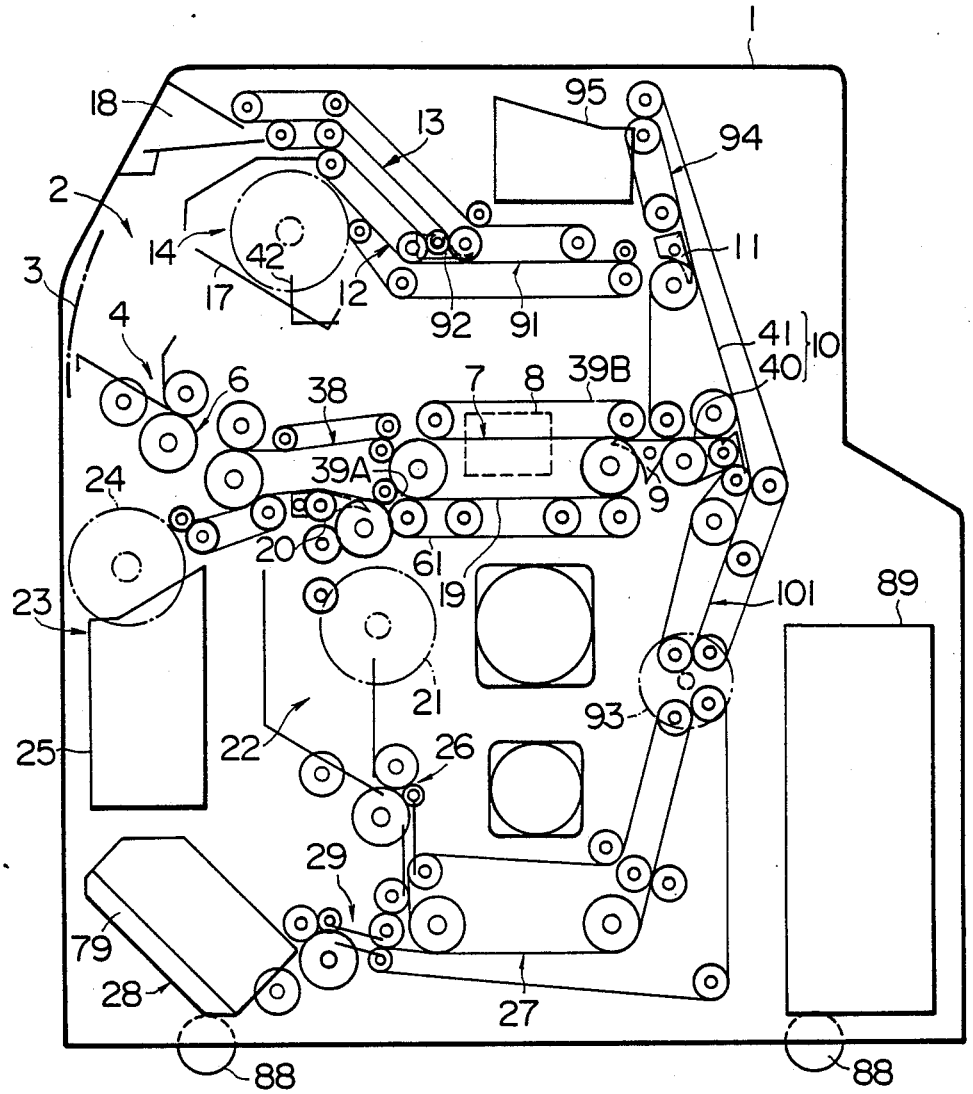
FIG. 13 is a schematic view similar to FIG. 1 but showing another embodiment of the present invention.
Figure 14:
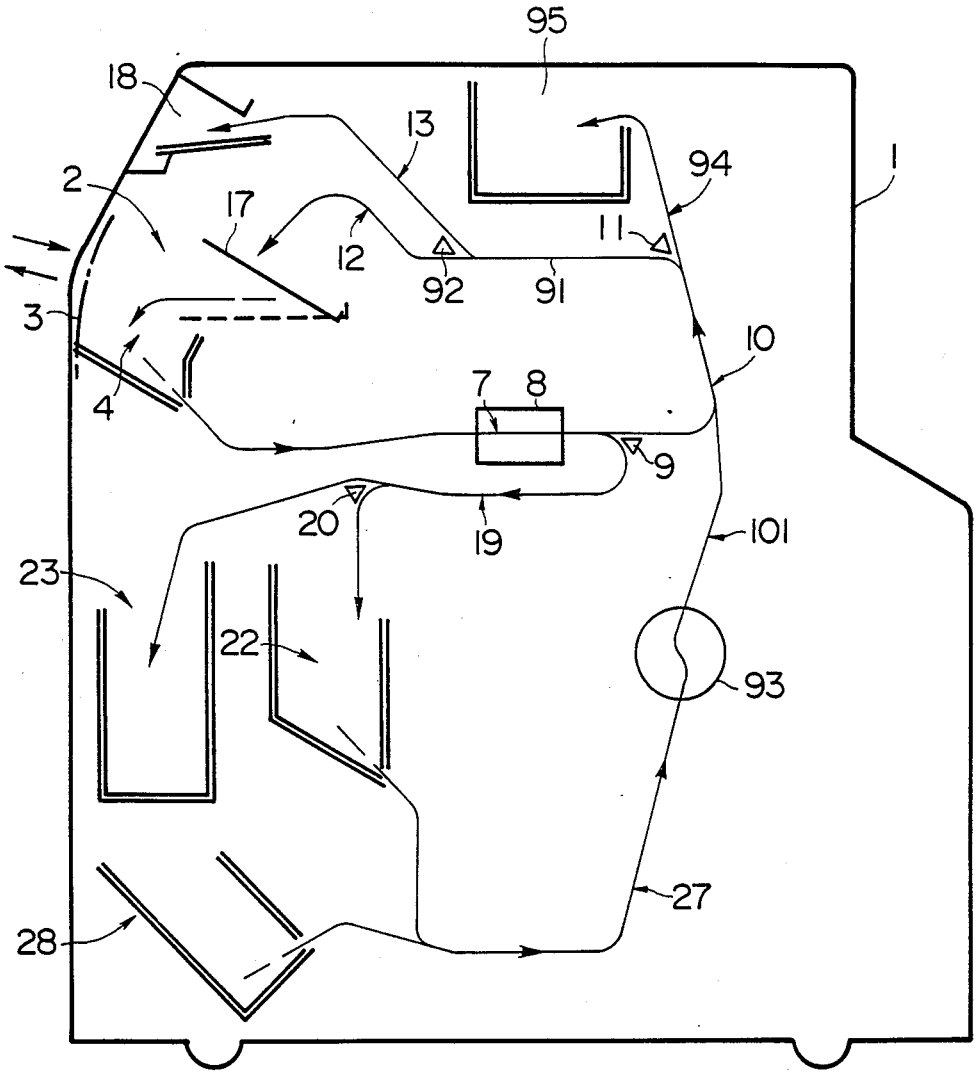
FIG. 14 is a schematic view similar to FIG. 2 of the embodiment of FIG. 13.

Referring to FIG. 13 and 14, there is shown a money receiving and disbursing machine in accordance with another embodiment of the present invention.

In this embodiment, the money disbursing route 27 is connected with the common route directly through a connecting conveying section 101 so that the fifth fork 30 is omitted. As a result, when an abnormal conveyance occurs during the money disbursing operation, all the bank notes in conveyance are introduced into the reject box 95 through the reject route 94 so that the bank notes for disbursing are surely kept away from the bank note received in the machine 1 by a depositing operation.

In still another embodiment of the present invention, the reject route 94 can be provided at the rear end of the money disbursing route 27 as a divisional route of the route 27. In this embodiment, the second fork 11 is located upstream of the fifth fork 30 so that the bank notes of an abnormal conveyance during the money disbursing operation are conveyed through the money disbursing route 27 thereafter the reject route 94 when the distribution route 19 is occupied. When the distribution route 19 is out of operation, the bank notes are introduced into the route 19 by controlling the second and fifth forks 11 and 30.

In the case where the distributing route is out of operation, the money disbursing route 27 is connected with the distributing route 19 so that the circulating bank note among the bank note in abnormal conveyance can be introduced into the circulating money storage section 22 and other denomination of bank notes can be introduced into the received money storage 23 through the fourth fork 20.

It will be apparent from the above description that many modifications and variations may be made by those skilled in the art without apart from the scope of the claimed invention as attached.

We claim:

1. A money receiving and disbursing machine comprising transaction window means opened to outside of the machine, discriminating route means for discriminating at least denominations and genuineness of bank notes introduced into the machine and counting their value, circulating money storage means provided below the discriminating route means and at a central portion of the machine for storing a predetermined denomination of bank notes which are adapted to be circulated and used for disbursing, received money storage means juxtaposed with and in front of the circulating money storage means for storing bank notes of denominations other than the predetermined denomination, distributing route means for connecting said discriminating route means with said circulating money storage means and said received money storage means, temporary hold means for temporarily holding the bank notes received in the machine until a money discrimination process is completed and returning the bank notes held therein to the transaction window means, disbursing money storage means provided below the circulating money storage means and the received money storage means for storing bank notes of denominations other than the predetermined denomination, money disbursing route means connected with said circulating money storage means and said disbursing money storage means via a disbursing mechanism which takes out the bank notes stored in the circulating money storage means and the disbursing money storage means one by one, disbursing money discriminating means provided in the money disbursing route means for discriminating at least the denominations, genuineness of the bank notes being transferred and an abnormal condition therein and counting their value, common route means connected with the discriminating route means and the money disbursing route means, reject fork means provided in said common route means for introducing the bank notes in abnormal condition to reject route means and introducing the bank notes in normal condition to said temporary hold means, first switching fork means provided at an end portion of said discriminating route means for selectively connecting said discriminating route means with the common route means or the distributing route means, and reject box means for receiving the bank notes in the abnormal condition through said reject route means.

2. A machine in accordance with claim 1, wherein only one predetermined denomination of bank notes received in the machine are circulated for disbursing.

3. A machine in accordance with claim 1, wherein said disbursing money storage means is mounted on the machine in an inclined attitude.

4. A machine in accordance with claim 1, wherein bank notes received in the machine other than said predetermined denomination of bank notes are introduced in said received money storage means for storing.

5. A machine in accordance with claim 1, wherein bank notes having said predetermined denomination of bank notes are taken out of said circulating money storage means and bank notes other than the predetermined denomination of bank notes are taken out of said disbursing money storage means for disbursement.

6. A machine in accordance with claim 1, wherein bank notes received in the machine through said transaction window means are introduced into said temporary hold means through said discriminating route means and said common route means and into said transaction window means and said discriminating route means again, thereafter said predetermined denomination of the bank notes being introduced into said circulating money storage means and the bank notes other than said predetermined denomination of the bank notes being introduced into said received money storage means.

7. A machine in accordance with claim 6, wherein said temporary hold means is provided upward of said transaction window means so that bank notes in said temporary hold means are introduced into said transaction window means by gravity.

8. A machine in accordance with claim 1, wherein the machine is provided at the front end with a door being adapted to be opened, and the received money storage means being removably mounted on the door.

9. A machine in accordance with claim 1, further comprising second switching fork means provided at an end portion of said money disbursing route means for selectively connecting said money disbursing route means with said distributing route means or the common route means, and control means for controlling said reject fork means and said second switching fork means, thereby to introduce the bank notes in the abnormal condition selectively to said reject route means or said distributing route means.

10. A machine in accordance with claim 9, wherein said control means controls said second switching fork means so as to connect said money disbursing route means with said distributing route means so that the bank notes in the abnormal condition are introduced into said received money storage means through said distributing route means when the distributing route means includes an absence of the bank notes received in the machine through said transaction window means, and said control means controls said second switching fork means so as to connect said money disbursing route means with said common route means and said reject fork means so that the bank notes in the abnormal condition are introduced into said reject box means through said common route means and said reject route means when said distributing route means is occupied by the bank notes received in the machine through said transaction window means.

* * * * *